US005164706A

United States Patent [19]

Chen

[11] Patent Number: 5,164,706

[45] Date of Patent: Nov. 17, 1992

[54] BRIEFCASE/HANDBAG ALARM DEVICE

[76] Inventor: Yoky Chen, No. 38 Hsiao Tung Road, Hsiao Tung Subward Teu Nan Yunlin Hsien, Taiwan

[21] Appl. No.: 757,530

[22] Filed: Sep. 11, 1991

[51] Int. Cl.[5] ..... G08B 13/26

[52] U.S. Cl. ..... 340/571; 340/562; 340/568

[58] Field of Search ..... 340/571, 568, 562

[56] References Cited

U.S. PATENT DOCUMENTS

| | | | |
|---|---|---|---|
| 2,927,311 | 3/1960 | Donaldson | 340/571 |
| 3,656,144 | 4/1972 | Forte | 340/571 |
| 3,815,118 | 6/1974 | McDonald | 340/571 |
| 4,091,371 | 5/1978 | Mason, Jr. et al. | 340/562 |
| 4,287,513 | 9/1981 | Lam et al. | 340/562 |
| 4,325,058 | 4/1982 | Wagner et al. | 340/562 |

*Primary Examiner*—Glen R. Swann, III

*Attorney, Agent, or Firm*—Larson and Taylor

[57] ABSTRACT

An alarm device connectable to a handbag or brief case includes a sensor built into an attachment strap that connects the housing of the device to the handbag or brief case. The alarm device also includes an electronic circuit that includes a continuous, high frequency oscillator that has a bypass capacitor connected in parallel to the sensor. A sound circuit is connected to the oscillator by the gate of a transistor and is normally reversed biased thereby. The sound circuit includes a dual oscillation circuit, an amplifier, and a speaker. When a human being or other creature approaches the sensor too closely, it creates an additional capacitance that is added to the capacitance of the bypass capacitor with the result that the oscillator stops oscillating, removing the reverse bias applied to the gate of the transistor. The speaker then emits a sound generated by the dual oscillation circuit.

4 Claims, 4 Drawing Sheets

BRIEFCASE/HANDBAG ALARM DEVICE

FIELD OF THE INVENTION

The present invention relates to an alarm device for briefcases and handbags. In particular, the present invention relates to a proximity alarm that detects the approach of a human being or creature.

BACKGROUND OF HE INVENTION currently, briefcases/handbags in the market don't have the feature of guarding against robbery or theft. Even if a few do, it is just a common lock or a combination lock located on the outside of the briefcase/handbag. These locks make it difficult to unlock. But what happens to people most often is that someone steals (or takes by mistake) the briefcase/handbag, especially on public occasions. However, an effective alarm device would surely reduce such occurrences greatly.

SUMMARY OF THE INVENTION

This invention relates to an alarm device for briefcases/ handbags. The basic feature is that an alarm device attached to briefcases/handbags employs a sensor to detect the approach of human beings or creatures. As human beings of creatures come into the detection range of the sensor, the high frequency oscillator of the alarm device ceases. At the same time, an alarm circuit is turned on by an capacitor switch so as to make a horn sound loudly to provide a warning effect.

DETAILED DESCRIPTION OF THE PREFERRED EMBODIMENT

This invention is an apparatus related to an alarm device or briefcase/handbag use. It mainly consists of a sensor, high frequency oscillators, rectifiers, etching circuit, amplifier circuit, and a horn. Basically, it uses a sensor to detect the approach of human being or creatures. Because the body is analogous to a capacitor or a resistor, it is like connecting a capacitor in parallel with a bypass capacitor of the high frequency oscillator. As a result, the oscillation of the high frequency oscillator ceases. In the meantime, the rectification voltage applied to the transistor TR2 is zero. The transistor TR3 is turned on. Consequently the collector of the transistor TR3 is at a higher potential and triggers a sound circuit. The sound circuit is a dual oscillation circuit formed by NAND gates, amplified by a transistor TR4 and with an output to a speaker. Therefore, by means of this simple mechanic, briefcases/handbags will have the feature of guarding against robbery or theft.

In view of the foreging the inventor sought to find a solution. After successive designs and improvements, the inventor finally worked out the present invention of an alarm device for briefcases/handbags. Its major objective is to provide an apparatus that can warn the owner and threaten thieves when someone else take the briefcase/handbag.

It is another object of this invention to provide an alarm device for briefcases/handbags, which can be easily installed or taken off at nay time or any places.

A more complete understanding of the configuration and features of the present invention will become clear from a careful consideration of the following detailed description of certain embodiment illustrated int h accompanying drawings.

Figure 1:
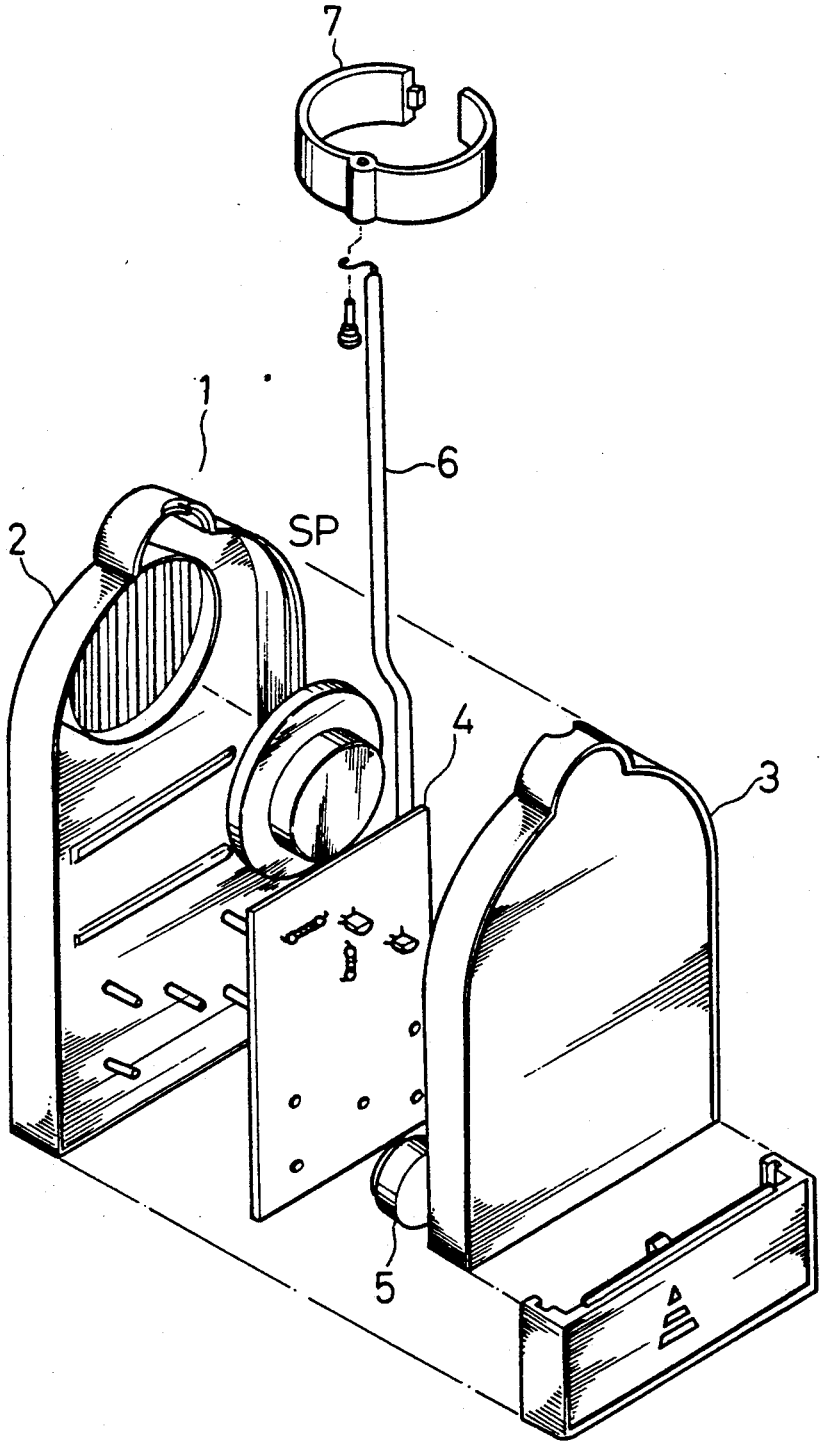
FIG. 1 is an exploded, perspective view of the essential part of an alarm device according to the invention.
Figure 2:
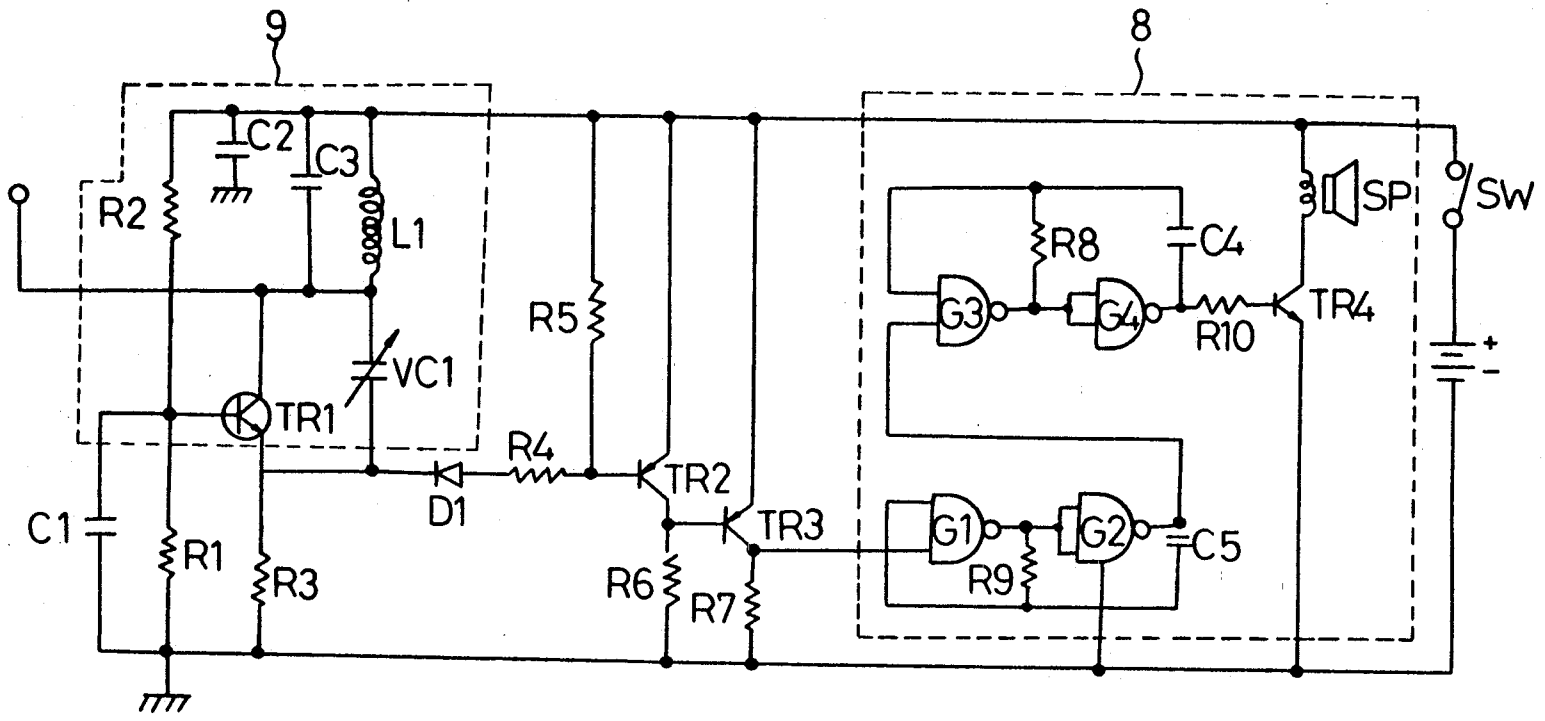
FIG. 2 is a circuit diagram of the invention.
Figure 3:
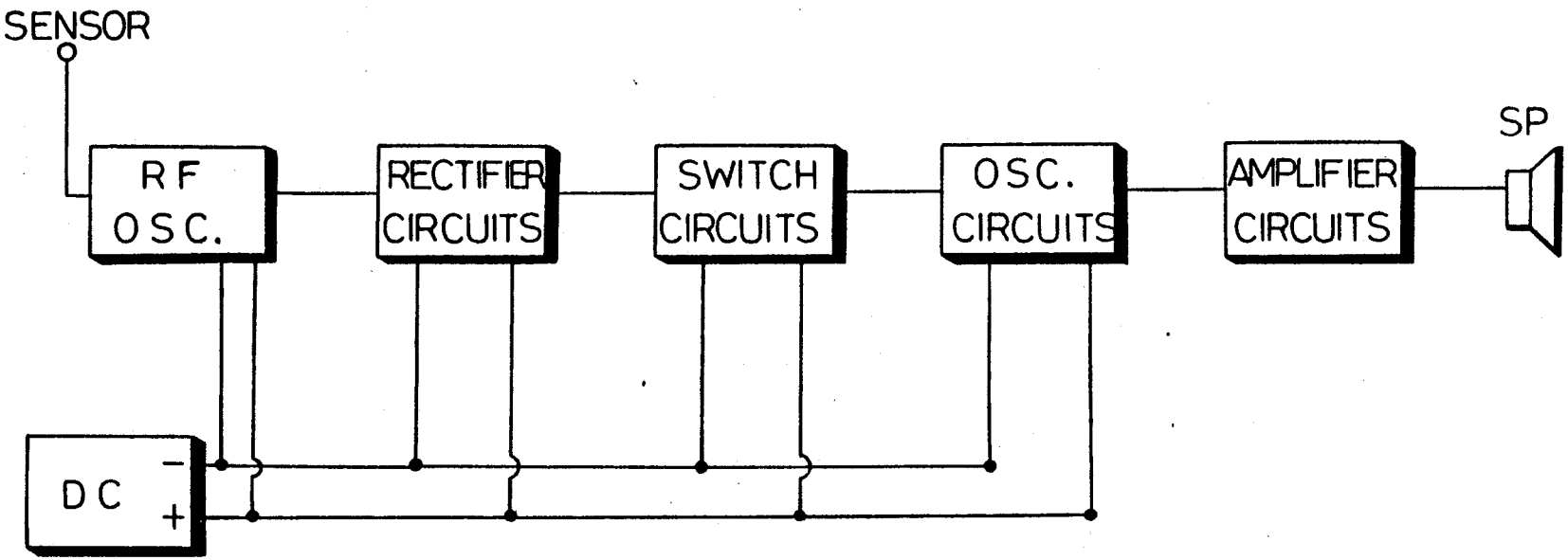
FIG. 3 is a system block diagram showing an embodiment of a circuit system of an alarm device according to the invention.
Figure 4:
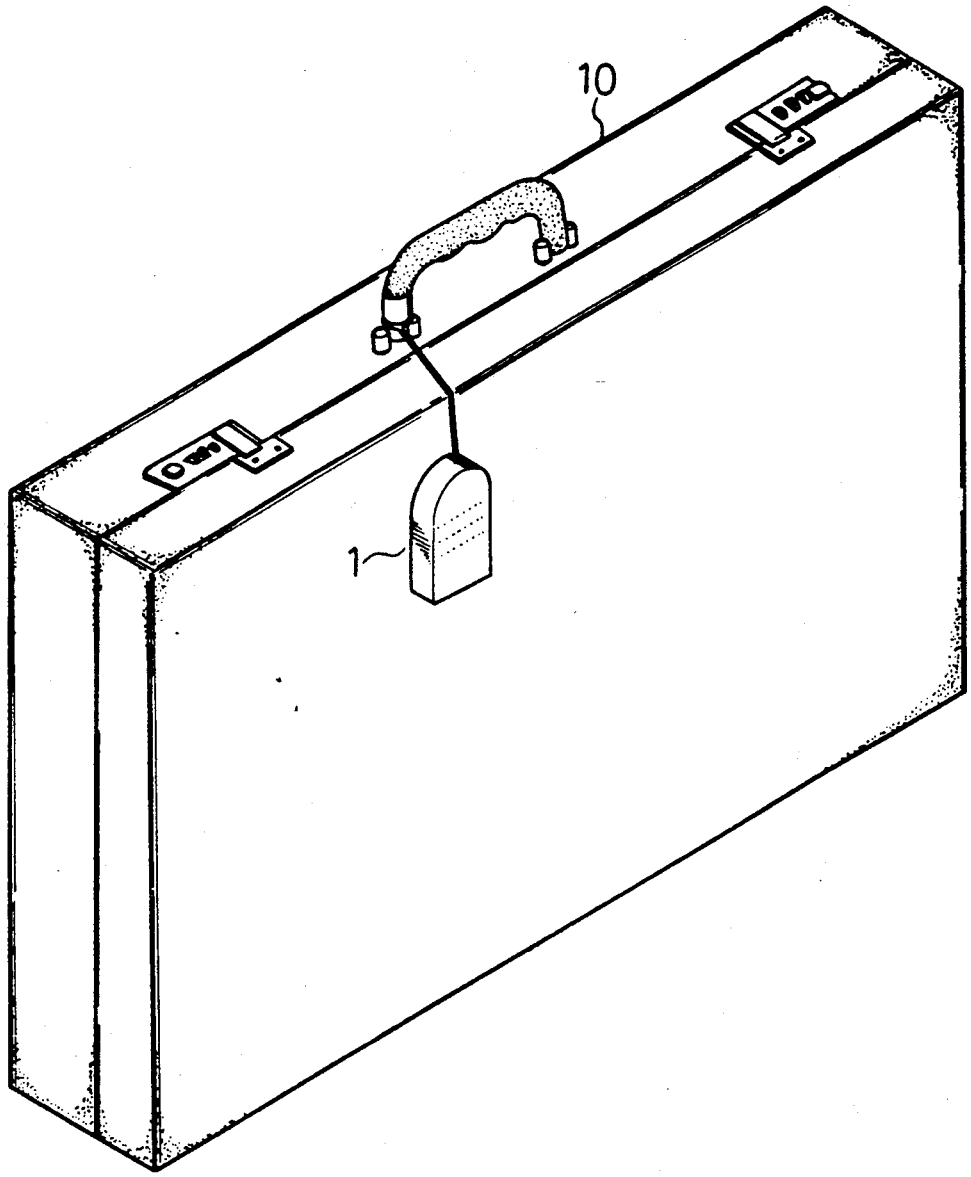
FIG. 4 is a perspective view of a briefcase depicting a practical example of the present invention.

FIG. 1 is an exploded, perspective view of this invention. The alarm device comprises two housings 2, 3 and a circuit board assembly 4 inside. The circuit board assembly 4 including high frequency oscillator, rectifier circuit, switch circuit, oscillation circuit and amplifier circuit is driven by the power source, battery 5. A conductor wire 6 connects the circuit board assembly 4 with a retainer 7. The retainer 7, besides securing the alarm device on the handle of briefcase/handbag, is used as a sensor detecting the approach of bodies and transferring the signals to the circuit board assembly 4. As the sensor 7 detects bodies, the high frequency oscillator ceases as if a capacitor were connected in parallel of the capacitor C1 (referring to FIG. 2). The rectification voltage exerted on the transistor TR2 is reduced t zero. The gase of transistor TR3 gets a forward bias de to eh existence of current through the resistor 6 and the transistor TR3 is turned on. The collector of transistor TR3 is at higher potential so that the alarm sound circuit 8 is triggered. The alarm sound circuit 8 includes a dual oscillation circuit comprising NAND gates, an intermittent sound control consisting of G1, G2, R9, C5; a sound oscillation device consisting of G3, G4, R8, and C4; a transistor TR4 having an amplification function, and an output speaker. As the switch of the alarm device is turned on, the alarm device is switched to a standby status. The oscillator in the high frequency oscillation circuit 9 comprising TR1, R1, R2, L1, and VC1 continuously oscillates. However, the voltage of high frequency oscillation circuit 9, rectified by the diode D1, is at a negative level and is connected to the base of the transistor TR2 through the resistor R4. The base of transistor TR2 gets a reverse bias via the resistor R5. Duet to rectification, the forward voltage is at a higher level. The transistor TR2 is turned on. The collector of the transistor TR2 is now at a higher electrical potential level. The FIG. 4 is a practical example of this invention. The alarm device is mounted on the handle to the briefcase/handbag by means of the retainer 7 that is a sensor. The alarm device 1 is now in standby state. When any body or any bodies or conductors are close enough to the retainer 7, the high frequency oscillator L1 will stop oscillation nd trigger the alarm sound circuit. Then the speaker SP sounds loudly to threaten thefts and remind the owner and people in the nearby area so that losses may be avoided. More over, when not using the alarm device, all we have to do is just open the retainer 7 and take it off from the briefcase/handbag 10. Hence, the installation and dismantlement is very simple.

What is claimed is:

1. An alarm device for and mountable on movable objects such as briefcases and handbags which have handles, the alarm devise comprising:

a sensor comprising a retainer that is of a conducive material and is mountable on the handle of a brief case or handbag;

a high frequency oscillation circuit that is normally continuously oscillating and which includes a bypass capacitor connected in parallel with said sensor, the sensor applying the capacitance of an approaching human being or other capture; and a sound circuit comprising a detection transistor having a base connected to said high frequency oscillation circuit such that a reverse bias is normally applied by said high frequency oscillation circuit to said transistor base resulting in said sound circuit keeping quiet;

whereby when said sensor senses the capacitance of an approaching human being or other capture, the oscillation of said high frequency oscillation circuit ceases and sounded circuit transistor is turned on which triggers said the detection.

2. The alarm device as claimed in claim 1, wherein said sound circuit is comprised of a sound oscillation circuit, an amplifier means for amplifying the output of said sound oscillation circuit, and a speaker connected to said amplifier.

3. The alarm device as claimed in claim 2 wherein said sound oscillation circuit comprises dual, serially connected NAND gate osicllators.

4. The alarm device as claimed in claim 2 wherein said sound circuit further includes a switching transistor that is controlled by the output of said detection transistor.

* * * * *